US012173430B2

(12) United States Patent
Moskowitz et al.

(10) Patent No.: US 12,173,430 B2
(45) Date of Patent: Dec. 24, 2024

(54) PROCESS FOR PRODUCING CARBON FIBERS AND CARBON FIBERS MADE THEREFROM

(71) Applicant: Cytec Industries Inc., Princeton, NJ (US)

(72) Inventors: Jeremy Moskowitz, Mauldin, SC (US); Thomas Taylor, Greenville, SC (US); Amy Tucker, Central, SC (US); Alan Thomas, Mauldin, SC (US); Billy Harmon, Simpsonville, SC (US)

(73) Assignee: Cytec Industries Inc., Princeton, NJ (US)

( * ) Notice: Subject to any disclaimer, the term of this patent is extended or adjusted under 35 U.S.C. 154(b) by 760 days.

(21) Appl. No.: 15/734,691

(22) PCT Filed: Jun. 5, 2019

(86) PCT No.: PCT/US2019/035567
§ 371 (c)(1),
(2) Date: Dec. 3, 2020

(87) PCT Pub. No.: WO2019/236696
PCT Pub. Date: Dec. 12, 2019

(65) Prior Publication Data

US 2021/0230775 A1 Jul. 29, 2021

Related U.S. Application Data

(60) Provisional application No. 62/681,353, filed on Jun. 6, 2018.

(51) Int. Cl.
*D01D 5/06* (2006.01)
*D01D 5/08* (2006.01)
*D01F 9/22* (2006.01)

(52) U.S. Cl.
CPC ..... *D01D 5/06* (2013.01); *D01D 5/08* (2013.01); *D01F 9/22* (2013.01)

(58) Field of Classification Search
CPC ..... D01D 5/06; D01D 5/08; D01F 9/22
See application file for complete search history.

(56) References Cited

U.S. PATENT DOCUMENTS

| | | | | |
|---|---|---|---|---|
| 4,412,937 | A * | 11/1983 | Ikegami | D01F 9/22 423/447.5 |
| 4,661,336 | A | 4/1987 | McCabe | |
| 2010/0272978 | A1 | 10/2010 | Kumar et al. | |
| 2010/0278716 | A1 | 11/2010 | Sudo et al. | |
| 2014/0306364 | A1* | 10/2014 | Naskar | D01F 9/20 423/447.4 |
| 2015/0210813 | A1 | 7/2015 | Arai et al. | |

FOREIGN PATENT DOCUMENTS

| | | | |
|---|---|---|---|
| CN | 105968524 | A * | 9/2016 |
| KR | 20100087321 | A | 8/2010 |

OTHER PUBLICATIONS

Zhang, Wang Xi et al. 'Manufacture of carbon fibers from polyacrylonitrile precursors treated with CoS04.' Journal of Applied Polymer Science, 2002, vol. 85, pp. 153-158 (See p. 154; and experimental section).

Yang, Chengran et al. Preparation and properties of polyacrylonitrile, fibers with guanidine groups. Fibers and Polymers, 2015, vol. 16, pp. 1611-1617.

Office Action issued in corresponding KR Application No. 20217000011 with English translation dated Mar. 27, 2024 (13 pages).

* cited by examiner

*Primary Examiner* — Farah Taufiq
(74) *Attorney, Agent, or Firm* — Osha Bergman Watanabe & Burton LLP

(57) ABSTRACT

The present disclosure relates to a process for producing carbon fibers utilizing a salt of an organic cation containing C═N imine group, and carbon fibers produced by such process.

17 Claims, No Drawings

PROCESS FOR PRODUCING CARBON FIBERS AND CARBON FIBERS MADE THEREFROM

CROSS REFERENCE TO RELATED APPLICATIONS

The present application is a U.S. national phase entry under 35 U.S.C. § 371 of International Application No. PCT/US2019/035567, filed on Jun. 5, 2019, which claims priority of U.S. Provisional Application No. 62/681,353, filed Jun. 6, 2018. The entire contents of these applications are explicitly incorporated herein by this reference.

FIELD OF THE INVENTION

The present disclosure relates generally to a process for producing carbon fibers in which a salt of an organic cation containing a C═N imine group is present in at least one step of the process. The present disclosure also relates to carbon fibers produced by such process.

BACKGROUND

Carbon fibers have been used in a wide variety of applications because of their desirable properties, such as high strength and stiffness, high chemical resistance and low thermal expansion. For example, carbon fibers can be formed into a structural part that combines high strength and high stiffness, while having a weight that is significantly lighter than a metal component of equivalent properties. Increasingly, carbon fibers are being used as structural components in composite materials for aerospace and automotive applications, among others. In particular, composite materials have been developed wherein carbon fibers serve as a reinforcing material in a resin or ceramic matrix.

Carbon fiber from acrylonitrile is generally produced by a series of manufacturing steps or stages. Acrylonitrile monomer is first polymerized by mixing it with one or more co-monomers (e.g., itaconic acid, methacrylic acid, methyl acrylate and/or methyl methacrylate) and reacting the mixture with a catalyst to form polyacrylonitrile (PAN) polymer. PAN is currently the most widely used precursor for carbon fibers.

Once polymerized, the PAN polymer may be isolated by typical means or provided as a solution (i.e., spin "dope"). PAN polymer may be converted into precursor fibers by any number of methods known to those of ordinary skill in the art, including, but not limited to, melt spinning, dry spinning, wet spinning, gel spinning, among others.

In one method (dry spinning), the heated dope is pumped (filtered) through tiny holes of a spinnerette into a tower or chamber of heated inert gas where the solvent evaporates, leaving a solid fiber.

In another method (wet spinning), the heated polymer solution ("spinning dope") is pumped through tiny holes of a spinnerette into a coagulation bath where the spinning dope coagulates and solidifies into fibers. Wet spinning can be further divided into one of the minor processes of (1) wet-jet spinning, wherein the spinnerette is submerged in the coagulation bath; (2) air gap or dry jet spinning, wherein the polymer jets exit the spinnerette and pass through a small air gap (typically 2-10 mm) prior to contacting the coagulation bath; and (3) gel spinning, wherein the dope is thermally induced to phase change from a fluid solution to a gel network. In both dry and wet spinning methods, the fiber is subsequently washed and stretched through a series of one or more baths.

After spinning and stretching the precursor fibers and before they are carbonized, the fibers need to be chemically altered to convert their linear molecular arrangement to a more thermally stable molecular ladder structure. This is accomplished by heating the fibers in air to about 200-300° C. (about 390-590° F.) for about 30-120 minutes. This causes the fibers to pick up oxygen molecules from the air and rearrange their atomic bonding pattern. This oxidation or thermal stabilization step can occur by a variety of processes, such as drawing the fibers through a series of heated chambers or passing the fibers over hot rollers.

After oxidation, the stabilized precursor fibers are heated (carbonized) to a maximum temperature of about 1000-3000° C. (about 1800-5500° F.) for several minutes in one or two furnaces filled with a gas mixture free of oxygen. As the fibers are heated, they begin to lose their non-carbon atoms in the form of various gases such as water vapor, hydrogen cyanide, ammonia, carbon monoxide, carbon dioxide, hydrogen and nitrogen. As the non-carbon atoms are expelled, the remaining carbon atoms form tightly bonded carbon crystals that are aligned parallel to the long axis of the fiber.

The resultant carbon fibers have a surface that does not bond well with epoxies and other materials used in composite materials. To give the fibers better bonding properties, their surface may be slightly oxidized. The addition of oxygen atoms to the surface provides better chemical bonding properties and also removes weakly bound crystallites for better mechanical bonding properties. Once oxidized, the carbon fibers may be coated ("sized") to protect them from damage during winding or weaving.

Oxidation of precursor fibers is a time consuming step in the continuous manufacturing of carbon fiber. The high oven temperatures and slow throughput inhibits efforts to reduce cost. Several means to address the issue of slow oxidation, including plasma treatment, microwave, proton irradiation, and chemical post-spinning treatments, are known. However, the production feasibility of such methods has not been realized and the means to control such methods in a continuous fashion is still underdeveloped.

Thus, there is an ongoing need for the development of continuous processes for producing carbon fibers that employ lower oven temperatures and exhibit higher throughput, thereby reducing costs, without compromising or even with improvement of the physical properties, such as tensile strength and modulus of elasticity, of the produced carbon fibers.

Herein, a new strategy for the production of carbon fibers that would address one or more of the aforementioned disadvantages is described.

SUMMARY OF THE INVENTION

In a first aspect, the present disclosure relates to a process for producing carbon fibers, the process comprising:

a) preparing a polymer solution or a molten polymer;

b) spinning the polymer solution or the molten polymer prepared in step (a); thereby forming carbon fiber precursor fibers;

c) drawing the carbon fiber precursor fibers through one or more draw and wash baths, resulting in drawn carbon fiber precursor fibers that are substantially free of solvent; and d) oxidizing the drawn carbon fiber precursor fibers of step c) to form stabilized carbon fiber precursor fibers and then carbonizing the stabilized carbon fiber precursor fiber, thereby producing carbon fibers;

wherein at least one salt of an organic cation containing a C═N imine group is present in at least one of the steps a) to c).

In a second aspect, the present disclosure relates to a carbon fiber produced by the process described herein.

DETAILED DESCRIPTION

As used herein, the terms "a", "an", or "the" means "one or more" or "at least one" and may be used interchangeably, unless otherwise stated.

As used herein, the term "comprises" includes "consists essentially of" and "consists of." The term "comprising" includes "consisting essentially of" and "consisting of."

The first aspect of the present disclosure relates to a process for producing carbon fibers, the process comprising:

a) preparing a polymer solution or a molten polymer;

b) spinning the polymer solution or the molten polymer prepared in step (a); thereby forming carbon fiber precursor fibers;

c) drawing the carbon fiber precursor fibers through one or more draw and wash baths, resulting in drawn carbon fiber precursor fibers that are substantially free of solvent; and d) oxidizing the drawn carbon fiber precursor fibers of step c) to form stabilized carbon fiber precursor fibers and then carbonizing the stabilized carbon fiber precursor fiber, thereby producing carbon fibers;

wherein at least one salt of an organic cation containing a C═N imine group is present in at least one of the steps a) to c).

Preparing the polymer solution or the molten polymer begins with synthesis of the polymer. The polymer, typically a polyacrylonitrile-based (PAN) polymer, can be made by any polymerization method known to those of ordinary skill in the art. Exemplary methods include, but are not limited to, solution polymerization, dispersion polymerization, precipitation polymerization, suspension polymerization, emulsion polymerization, and variations thereof.

In an embodiment, step (a) comprises preparing a polymer solution.

One suitable method comprises mixing acrylonitrile (AN) monomer and one or more co-monomers in a solvent, forming a solution. The solution is heated to a temperature above room temperature (i.e., greater than 25° C.), for example, to a temperature of about 40° C. to about 85° C. After heating, an initiator is added to the solution to initiate the polymerization reaction. Once polymerization is completed, unreacted AN monomers are stripped off (e.g., by de-aeration under high vacuum) and the resulting PAN polymer solution is cooled down. At this stage, the polymer is in a solution, or dope, form. The salt of an organic cation containing a C═N imine group may be added directly to the polymer solution or dope.

Thus, in an embodiment, preparing the polymer solution comprises forming the polymer in a medium, typically one or more solvents, in which the polymer is soluble to form a solution, and optionally adding the salt of an organic cation containing a C═N imine group to the solution to form the polymer solution.

In an embodiment, the salt of an organic cation containing a C═N imine group is added to the polymer solution in an amount from 0 to 2 wt %, typically 0.5 to 1 wt %, relative to the weight of the polymer solution.

In another suitable method, AN monomer and one or more co-monomers may be polymerized in a medium, typically aqueous medium, in which the resulting polymer is sparingly soluble or non-soluble. In this manner, the resulting polymer would form a heterogenous mixture with the medium. Before the polymer, typically in the form of white powder, is filtered and dried, a salt of an organic cation containing a C═N imine group, which may be in natural form or in the form of an aqueous solution, may be added to the mixture. The resulting product is then filtered and dried. To prepare the spinning solution by this method, the resulting powder can then be dissolved in one or more solvents to form the spinning solution.

Thus, in an embodiment, preparing the polymer solution comprises forming the polymer in a medium, typically aqueous medium, in which the polymer is sparingly soluble or non-soluble to form a mixture, optionally adding a salt of an organic cation containing a C═N imine group to the mixture, isolating the resulting polymer, and dissolving the resulting polymer in one or more solvents to form the polymer solution.

In an embodiment, the salt of an organic cation containing a C═N imine group added to the mixture is in the form of aqueous solution, the concentration of the salt in the aqueous solution being 2 wt % to 30 wt %, typically 5 wt % to 20 wt %, relative to the weight of the aqueous solution.

In another embodiment, the concentration of the salt in the aqueous solution is 0.1 wt % to 2 wt %, relative to the weight of the aqueous solution.

Alternatively, the resulting polymer may be filtered and dried before contact with the salt of an organic cation containing a C═N imine group. In this manner, the dried polymer, typically in the form of white powder, is combined with an aqueous solution of a salt of a organic cation containing a C═N imine group. The polymer, which is insoluble in the aqueous solution of the salt of an organic cation containing a C═N imine group, is then filtered and dried. To prepare the spinning solution, the treated polymer powder is then dissolved in one or more solvents to form the spinning solution.

Thus, in an embodiment, preparing the polymer solution comprises forming the polymer in a medium, typically aqueous medium, in which the polymer is sparingly soluble or non-soluble, isolating the resulting polymer, typically in the form of particles or powder, treating the polymer with an aqueous solution of a salt of an organic cation containing a C═N imine group, isolating the resulting treated polymer, typically in the form of particles or powder, and dissolving the treated polymer in one or more solvents to form the polymer solution. Treating the polymer with an aqueous solution of a salt of an organic cation containing a C═N imine group may be achieved using any method known to those of ordinary skill in the art. For example, the polymer may be suspended in the aqueous solution of the salt for a time or the aqueous solution of the salt may be sprayed or misted onto the polymer.

In an embodiment, the concentration of the salt in the aqueous solution is 0.1 wt % to 2 wt %, relative to the weight of the aqueous solution.

The ratio of polymer-to-aqueous solution is not particularly limited. However, a suitable ratio of polymer-to-aqueous solution is 1:1 to 1:50 by weight, typically 1:3 to 1:45 by weight, more typically 1:10 to 1:20 by weight.

In another embodiment, step (a) comprises preparing a molten polymer. Preparing the molten polymer may be achieved according to any method known to those having ordinary skill in the art. In a suitable method, preparing the molten polymer comprises forming the polymer in a medium, typically aqueous medium, in which the polymer is sparingly soluble or non-soluble to form a mixture, optionally adding a salt of an organic cation containing a C═N imine group to the mixture, and isolating the resulting polymer, for example, by filtration and then drying. The polymer is then heated until it is in a molten state suitable for processing through a spinneret. The salt of an organic cation containing a C═N imine group may optionally be added to the molten polymer.

The polymer may be made by polymerizing a formulation comprising acrylonitrile and less than or equal to 20%, typically less than or equal to 10%, more typically less than or equal to 5%, by weight of co-monomer, relative to the weight of the formulation.

In an embodiment, the formulation comprises greater than or equal to 90% acrylonitrile, less than or equal to 5% co-monomer, and less than or equal to 1% initiator, by weight relative to the total weight of the components. A sufficient amount of solvent to form a solution containing at least 10 wt % of final polymer, typically 16 wt % to 28 wt % of final polymer, more typically 19 wt % to 24 wt %, is used.

Examples of suitable solvents include, but are not limited to, dimethyl sulfoxide (DMSO), dimethyl formamide (DMF), dimethyl acetamide (DMAc), ethylene carbonate (EC), zinc chloride ($ZnCl_2$)/water and sodium thiocyanate (NaSCN)/water.

Examples of suitable comonomers include, but are not limited to, vinyl-based acids, such as methacrylic acid (MAA), acrylic acid (AA), and itaconic acid (ITA); vinyl-based esters, such as methacrylate (MA), ethyl acrylate (EA), butyl acrylate (BA), methyl methacrylate (MMA), ethyl methacrylate (EMA), propyl methacrylate, butyl methacrylate, β-hydroxyethyl methacrylate, dimethylaminoethyl methacrylate, 2-ethylhexylacrylate, isopropyl acetate, vinyl acetate (VA), and vinyl propionate; vinyl amides, such as vinyl imidazole (VIM), acrylamide (AAm), and diacetone acrylamide (DAAm); vinyl halides, such as allyl chloride, vinyl bromide, vinyl chloride and vinylidene chloride; ammonium salts of vinyl compounds and sodium salts of sulfonic acids, such as sodium vinyl sulfonate, sodium p-styrene sulfonate (SSS), sodium methallyl sulfonate (SMS), and sodium-2-acrylamido-2-methyl propane sulfonate (SAMPS), among others.

In an embodiment, the polymer is made by polymerizing acrylonitrile with co-monomers selected from the group consisting of methacrylic acid (MAA), acrylic acid (AA), itaconic acid (ITA), vinyl-based esters, typically, methacrylate (MA), methyl methacrylate (MMA), vinyl acetate (VA), ethyl acrylate (EA), butyl acrylate (BA), ethyl methacrylate (EMA); and other vinyl derivatives, typically, vinyl imidazole (VIM), acrylamide (AAm), and diacetone acrylamide (DAAm), and mixtures thereof.

In another embodiment, the polymer is made by polymerizing acrylonitrile with co-monomers selected from the group consisting of itaconic acid, methacrylic acid, methyl acrylate, and mixtures thereof.

Suitable initiators (or catalysts) for the polymerization include, but are not limited to, azo-based compounds, such as azo-bisisobutyronitrile (AIBN), azobiscyanovaleric acid (ACVA), and 2,2'-azobis-(2,4-dimethyl) valeronitrile (ABVN), among others; and organic peroxides, such as dilauroyl peroxide (LPO), di-tert-butyl peroxide (TBPO), diisopropyl peroxydicarbonate (IPP), among others.

The salt of an organic cation containing a C═N imine group is a compound comprising an organic cation containing a C═N imine group and an anion, which may be organic or inorganic, such as carbonate, sulfate, nitrate or acetate. Suitable salts include, but are not limited to, salts of guanidinium ion, amidinium ion, typically acetamidinium ion, and pyrimidinium ion. In an embodiment, the salt of an organic cation containing a C═N imine group is a salt of guanidinium ion. In another embodiment, the salt of an organic cation containing a C═N imine group is guanidine carbonate.

After the polymer solution or molten polymer is prepared, carbon fiber precursor fibers are formed by spinning the polymer solution or molten polymer.

In an embodiment, step (b) comprises spinning the polymer solution prepared in step a) in a coagulation bath. The term "precursor fiber" refers to a fiber comprising a polymeric material that can, upon the application of sufficient heat, be converted into a carbon fiber having a carbon content that is about 90% or greater, and in particular about 95% or greater, by weight.

To make the carbon fiber precursor fibers, the polymer solution (i.e., spin "dope") is subjected to conventional wet spinning and/or air-gap spinning after removing air bubbles by vacuum. The spin dope can have a polymer concentration of at least 10 wt %, typically from about 16 wt % to about 28 wt % by weight, more typically from about 19 wt % to about 24 wt %, based on total weight of the solution. In wet spinning, the dope is filtered and extruded through holes of a spinneret (typically made of metal) into a liquid coagulation bath for the polymer to form filaments. The spinneret holes determine the desired filament count of the fiber (e.g., 3,000 holes for 3K carbon fiber). In air-gap spinning, a vertical air gap of 1 to 50 mm, typically 2 to 10 mm, is provided between the spinneret and the coagulating bath. In this spinning method, the polymer solution is filtered and extruded in the air from the spinneret and then extruded filaments are coagulated in a coagulating bath.

The coagulation liquid used in the process is a mixture of solvent and non-solvent. Water or alcohol is typically used as the non-solvent. Suitable solvents include the solvents described herein. In an embodiment, dimethyl sulfoxide, dimethyl formamide, dimethyl acetamide, or mixtures thereof, is used as solvent. In another embodiment, dimethyl sulfoxide is used as solvent. The ratio of solvent and non-solvent, and bath temperature are not particularly limited and may be adjusted according to known methods to achieve the desired solidification rate of the extruded nascent filaments in coagulation. However, the coagulation bath typically comprises 40 wt % to 85 wt % of one or more solvents, the balance being non-solvent, such as water or alcohol. In an embodiment, the coagulation bath comprises 40 wt % to 70 wt % of one or more solvents, the balance being non-solvent. In another embodiment, the coagulation bath comprises 50 wt % to 85 wt % of one or more solvents, the balance being non-solvent.

Typically, the temperature of the coagulation bath is from 0° C. to 80° C. In an embodiment, the temperature of the coagulation bath is from 30° C. to 80° C. In another embodiment, the temperature of the coagulation bath is from 0° C. to 20° C.

The salt of an organic cation containing a C═N imine group described herein may be present in the coagulation bath in step b).

In this embodiment, when the salt of an organic cation containing a C═N imine group present is in the coagulation bath, the extruded nascent filaments coagulates and solidifies into fibers while in the presence of the salt.

In an embodiment, the salt of an organic cation containing a C═N imine group described herein is present in the coagulation bath in an amount of less than or equal to 15%; less than or equal to 8%; than or equal to 4%; less than or equal to 2%; or less than or equal to 1%, by weight relative to the weight of the coagulation bath.

According to the process of the present disclosure, the carbon fiber precursor fibers formed are in the coagulation bath for less than or equal to 15 minutes, typically less than or equal to 5 minutes, more typically less than or equal to 1 minute, for example, less than or equal to 30 seconds.

In another embodiment, step (b) comprises processing the molten polymer prepared in step (a) through a spinneret to form carbon fiber precursor fibers. In this manner, the molten polymer is pumped through a spinneret suitably selected by the ordinarily-skilled artisan for desired properties, such as desired filament count of the fiber. Upon leaving the spinneret, the molten polymer is cooled to form the carbon fiber precursor fibers.

The drawing of the carbon fiber precursor fibers is conducted by conveying the spun precursor fibers through one or more draw and wash baths, for example, by rollers. The carbon fiber precursor fibers are conveyed through one or more wash baths to remove any excess solvent and stretched in hot (e.g., 40° C. to 100° C.) water baths to impart molecular orientation to the filaments as the first step of controlling fiber diameter. The result is drawn carbon fiber precursor fibers that are substantially free of solvent.

According to the process of the present disclosure, the salt of an organic cation containing a C═N imine group may be present in one or more of the draw and wash baths in step c). In an embodiment, the salt is present in an amount of less than or equal to 15%; less than or equal to 8%; than or equal to 4%; less than or equal to 2%; or less than or equal to 1%, by weight relative to the weight of the one or more draw and wash baths.

In an embodiment, the carbon fiber precursor fibers are in the one or more draw and wash baths for less than or equal to 15 minutes, typically less than or equal to 5 minutes, more typically less than or equal to 1 minute, for example, less than or equal to 30 seconds.

In an embodiment, the carbon fiber precursor fibers are stretched from −5% to 30%, typically from 1% to 10, more typically from 3 to 8%.

Step c) of the process may further comprise drying the drawn carbon fiber precursor fibers that are substantially free of solvent, for example, on drying rolls. The drying rolls can be composed of a plurality of rotatable rolls arranged in series and in serpentine configuration over which the filaments pass sequentially from roll to roll and under sufficient tension to provide filaments stretch or relaxation on the rolls. At least some of the rolls are heated by pressurized steam, which is circulated internally or through the rolls, or electrical heating elements inside of the rolls. Finishing oil can be applied onto the stretched fibers prior to drying in order to prevent the filaments from sticking to each other in downstream processes.

As described herein, the salt of an organic cation containing a C═N imine group is present in at least one of the steps a) to c) and in an amount effective for the organic cation containing a C═N imine group to be substantially uniformly distributed throughout the carbon fiber precursor fibers formed in step c).

In step d) of the process described herein, the drawn carbon fiber precursor fibers of step c) are oxidized to form stabilized carbon fiber precursor fibers and, subsequently, the stabilized carbon fiber precursor fiber are carbonized to produce carbon fibers.

During the oxidation stage, the drawn carbon fiber precursor fibers, typically PAN fibers, are fed under tension through one or more specialized ovens, each having a temperature from 150 to 300° C., typically from 200 to 280° C., more typically from 220 to 270° C. Heated air is fed into each of the ovens. Thus, in an embodiment, the oxidizing in step d) is conducted in an air environment. The drawn carbon fiber precursor fibers are conveyed through the one or more ovens at a speed of from 4 to 100 fpm, typically from 30 to 75 fpm, more typically from 50 to 70 fpm.

The oxidation process combines oxygen molecules from the air with the fiber and causes the polymer chains to start crosslinking, thereby increasing the fiber density to 1.3 $g/cm^3$ to 1.4 $g/cm^3$. In the oxidization process, the tension applied to fiber is generally to control the fiber drawn or shrunk at a stretch ratio of 0.8 to 1.35, typically 1.0 to 1.2. When the stretch ratio is 1, there is no stretch. And when the stretch ratio is greater than 1, the applied tension causes the fiber to be stretched. Such oxidized PAN fiber has an infusible ladder aromatic molecular structure and it is ready for carbonization treatment.

Carbonization results in the crystallization of carbon molecules and consequently produces a finished carbon fiber that has more than 90 percent carbon content. Carbonization of the oxidized, or stabilized, carbon fiber precursor fibers occurs in an inert (oxygen-free) atmosphere inside one or more specially designed furnaces. In an embodiment, carbonizing in step d) is conducted in a nitrogen environment. The oxidized carbon fiber precursor fibers are passed through one or more ovens each heated to a temperature of from 300° C. to 1650° C., typically from 1100° C. to 1450° C.

In an embodiment, the oxidized fiber is passed through a pre-carbonization furnace that subjects the fiber to a heating temperature of from about 300° C. to about 900° C., typically about 350° C. to about 750° C., while being exposed to an inert gas (e.g., nitrogen), followed by carbonization by passing the fiber through a furnace heated to a higher temperature of from about 700° C. to about 1650° C., typically about 800° C. to about 1450° C., while being exposed to an inert gas. Fiber tensioning may be added throughout the precarbonization and carbonization processes. In pre-carbonization, the applied fiber tension is sufficient to control the stretch ratio to be within the range of 0.9 to 1.2, typically 1.0 to 1.15. In carbonization, the tension used is sufficient to provide a stretch ratio of 0.9 to 1.05.

Adhesion between the matrix resin and carbon fiber is an important criterion in a carbon fiber-reinforced polymer composite. As such, during the manufacture of carbon fiber, surface treatment may be performed after oxidation and carbonization to enhance this adhesion.

Surface treatment may include pulling the carbonized fiber through an electrolytic bath containing an electrolyte, such as ammonium bicarbonate or sodium hypochlorite. The chemicals of the electrolytic bath etch or roughen the surface of the fiber, thereby increasing the surface area available for interfacial fiber/matrix bonding and adding reactive chemical groups.

Next, the carbon fiber may be subjected to sizing, where a size coating, e.g. epoxy-based coating, is applied onto the fiber. Sizing may be carried out by passing the fiber through a size bath containing a liquid coating material. Sizing protects the carbon fiber during handling and processing into intermediate forms, such as dry fabric and prepreg. Sizing also holds filaments together in individual tows to reduce fuzz, improve processability and increase interfacial shear strength between the fiber and the matrix resin.

Following sizing, the coated carbon fiber is dried and then wound onto a bobbin.

A person of ordinary skill in the art would understand that the processing conditions (including composition of the spin solution and coagulation bath, the amount of total baths, stretches, temperatures, and filament speeds) are correlated to provide filaments of a desired structure and denier. The process of the present disclosure may be conducted continuously.

Carbon fibers produced according to the process described herein may be characterized by core ratio and mechanical properties, such as tensile strength and tensile modulus per the ASTM D4018 test method.

An advantage of the process of the present disclosure is the ability to produce carbon fibers that are more homogeneous and have less skin-core structure than carbon fibers produced by other methods. Skin-core structure refers to a structure in which the outer surface of the carbon fiber is more oxidized than the interior, or core, of the fiber. As a result, the outer surface forms a sheath, or skin, surrounding the core. As used herein, the term "core ratio" is defined as the ratio of the cross-sectional area of the core to the total sectional area of the fiber (multiplied by 100%). The core ratio may be determined using any methods known to those of ordinary skill in the art. For example, the cross sections of carbon fibers made according to the present process may be observed using optical microscopy and/or SEM. The cross-sectional area of the core and the total cross-sectional area are determined and then used to calculate the core ratio.

In an embodiment, the carbon fibers produced have a core ratio of from 10 to 50%.

In another embodiment, the carbon fibers produced have a core ratio of from 10 to 35%, typically 15 to 30%, more typically 18 to 25%.

In yet another embodiment, the carbon fibers produced have a core ratio of from 15 to 45%, typically 20 to 40%.

The tensile strength and tensile modulus of the carbon fibers produced according to the present process may be determined using the ASTM D4018 test method.

In an embodiment, the carbon fibers produced has a tensile strength of from 450 to 1000 ksi. In another embodiment, the carbon fibers produced have a tensile strength of from 600 to 1000 ksi, typically 700 to 1000 ksi, more typically 750 to 850 ksi. In yet another embodiment, the carbon fibers produced have a tensile strength of from 450 to 750 ksi, typically 500 to 700 ksi, more typically 550 to 650.

In an embodiment, the carbon fibers produced have a tensile modulus of from 30 to 48 msi. In another embodiment, the carbon fibers produced are intermediate modulus carbon fibers having a tensile modulus of from 39 to 48 msi, typically 39 to 43 msi, more typically 39 to 42 msi. In yet another embodiment, the carbon fibers produced are standard modulus carbon fibers having a tensile modulus of from 30 to 38 msi, typically 31 to 36 msi, more typically 32 to 35.5 msi.

The process according to the present disclosure and carbon fibers produced therefrom are further illustrated by the following non-limiting examples.

EXAMPLES

Example 1 (Comparative). Precursor Fiber Dipped in Guanidine Carbonate after Spinning/Drawing Intermediate modulus (IM) PAN precursor fibers (1% comonomer) were dipped in solutions containing 0, 2, 4, 7.5, and 15 wt % guanidine carbonate (GC) after spinning and drawing. The fibers were then oxidized in ovens heated to temperatures in the range of 230 to 275° C. Each fiber was run with 5% stretch.

The core ratios of the IM fibers dipped in the solutions containing various concentrations of GC were determined. The core ratios were calculated by the ratio of area of the core to the area of the whole fiber cross-section seen in optical microscopy. Table 1 summarizes the core ratios of the IM fibers dipped in the solutions containing various concentrations of GC after spinning and drawing. As shown in Table 1, the core ratio increases from 12.7% to over 30% at the highest treatment concentration.

TABLE 1

| GC concentration (wt %) | Core ratio (%) |
|---|---|
| 0 | 12.7 |
| 2 | 14.4 |
| 4 | 22.8 |
| 7.5 | 26.1 |
| 15 | 30.8 |

The IM fibers were also observed using SEM. The skin of the fiber was minimally impacted as compared to the control (untreated fiber). There was no evident damage to the fiber skin by treatment with the guanidine carbonate at 15 wt %. However, the 15 wt % fiber exhibited more fuzz and surface defects to the naked-eye. The surface shows some striations from the shell pointing into the core and diminishing before the center of the fiber.

The fibers were subsequently carbonized so that the mechanical properties of the resulting carbon fibers could be determined. The results are summarized in Table 2.

TABLE 2

| GC concentration (wt %) | Highest oven temp (° C.) | Survived carbonization | CF density (g/cm$^3$) | Modulus (Msi) | Tensile Strength (ksi) |
|---|---|---|---|---|---|
| 0 | 285° C. | Yes | 1.835 | 42.9 | 565 |
| 15 | 275° C. | Failed | n/a | n/a | n/a |
| 7.5 | 275° C. | Yes | 1.841 | 41.4 | 623 |
| 7.5 | 280° C. | Failed | n/a | n/a | n/a |
| 0 | 280° C. | Yes | 1.839 | 44.1 | 665 |
| 0 | 275° C. | Yes | 1.831 | 42.3 | 669 |

As shown in Table 2, the 15% fiber failed in carbonization possibly due to the large amount of fuzz. The 7.5% GC treated fiber also failed at the 280° C. final oxidation temperature perhaps due to the higher oxidation density on the surface.

Example 2 (Inventive). Precursor Fibers Dipped in Guanidine Carbonate in 1st Draw Bath IM PAN precursor, or white, fiber (1% comonomer) was made according to the air-gap spinning method with GC present in the 1$^{st}$ draw bath following coagulation. GC was present in the 1$^{st}$ draw bath at 7.5 wt %. The fiber treated in this manner had an apparent gold tint as it passed through the spin line and reached the winder. The color transformation was evidence of a chemical reaction and that the GC has at least made some effect on the fiber structure.

The thermal properties of the white fibers were then compared to those of untreated IM white fiber using differential scanning calorimetry (DSC) and thermal gravimetric analysis (TGA). DSC was carried out on a TA Instruments DSC Q2000, with Universal Analysis 2000. For exothermic properties, the DSC was equilibrated at 35° C. for 2 min and then ramped to 450° C. at a 10° C./min heating rate with 55 ml/min nitrogen flow rate. The sample sizes were 2-5 milligrams. TGA was carried out on a TA Instruments DSC Q600, with Universal Analysis 2000. TGA runs utilized temperature ramps at 10° C./min in nitrogen.

The DSC curve for the treated fiber exhibited a peak exotherm about 8° C. less than the control fiber (untreated fiber). The exotherm energy is almost exactly equal and the peak height is more than 50% reduced as compared to the control fiber. Furthermore, the densities of each fiber are almost equivalent, which validates that a negligible extent of oxidation occurred through the spinning process with drying temperatures above 100° C. The TGA degradation profiles overlapped very closely for the treated and control fibers. If any difference exists it is positive considering the treated fiber has a greater mass retention following degradation to 1,000° C.

The fibers were then treated to various oxidation profiles, as outlined in Table 3 and subsequently carbonized up to 1,300° C. with 5% stretch in precarbonization and 4% relax in carbonization. The various oxidation conditions are listed in Table 3 and the mechanical properties of the resulting carbon fibers are summarized in Table 4.

TABLE 3

| Ox condition | Ox speed (fpm) | Oxidation temp. range (° C.) |
|---|---|---|
| 1 | 4.5 | 230-275 |
| 2 | 4.5 | 220-260 |
| 3 | 4.5 | 200-270 |
| 4 | 6 | 200-265 |
| 5 | 6 | 200-270 |
| 6 | 4.5 | 230-270 |
| 7 | 4.5 | 200-260 |
| 8 | 8 | 235-280 |

TABLE 4

| Fiber | Ox condition | Tensile strength (ksi) | Tensile modulus (Msi) |
|---|---|---|---|
| Untreated | 1 | 677 | 38.7 |
| Treated | 1 | 501 | 35.0 |
| Treated | 2 | 551 | 41.0 |
| Treated | 3 | 533 | 39.2 |
| Untreated | 4 | 414 | 37.4 |
| Treated | 4 | 567 | 39.2 |
| Untreated | 5 | 462 | 34.2 |
| Treated | 5 | 534 | 38 |

As shown in Table 4, it is possible to achieve suitable carbon fiber properties at lower temperatures and higher throughputs. For conditions 4 and 5, the first oven temperatures were reduced to 200° C. and, for condition 5, the line speed was increased from 4.5 fpm to 6 fpm. The tensile properties of the treated fibers were better than those of the control (untreated) fiber oxidized under the same conditions. Even though the treated fiber did not meet the high strength of the control fiber made according to condition 1, it is shown herein that it is now possible to arrive at suitable carbon fiber properties at lower temperatures and higher throughputs. In this example, the 33% increase in line speed and significant reduction in oven temperatures would amount to substantial cost savings in the production of carbon fiber.

The skin-core profiles for fibers oxidized according to conditions 1, 2, and 3 were analyzed. Table 5 summarizes the core ratios of the IM fibers made in this example.

TABLE 5

| Condition | Core ratio (%) |
|---|---|
| 1 | 20.7 |
| 2 | 22.4 |
| 3 | 26.0 |

Notably, the core ratio of the fiber treated with GC in the 1$^{st}$ draw bath and oxidized according to condition 1 was 20.7%, which is reduced in comparison to the core ratio (26.1%) of the fiber of comparative example 1 and oxidized according to the same conditions.

Example 3 (Inventive). Precursor Fiber Dipped in Guanidine Carbonate in 1st Draw Bath Standard modulus (SM) PAN precursor fiber was prepared (4% comonomer) and was treated with GC in the 1$^{st}$ draw bath after coagulation in the manner as in Example 2, except that 2 wt % and 4 wt % GC was in the first draw bath and a high first draw stretch (4.74×) for the purposes of large tow spinning was employed.

The fibers treated with 4 wt % GC in the first draw bath were then oxidized and carbonized to determine effects on CF properties. The fibers were run at 5% stretch on oxidation and then in carbonization at 5% stretch precarb and 4% relax in carbonization. The oxidation conditions were conditions 6 and 7 shown in Table 3. The resulting carbon fiber properties are shown in Table 6 below.

TABLE 6

| Fiber | Ox condition | Tensile strength (ksi) | Tensile modulus (Msi) |
|---|---|---|---|
| Untreated | 6 | 699 | 35.8 |
| Treated | 6 | 581 | 35.8 |
| Untreated | 7 | 587 | 35.3 |
| Treated | 7 | 626 | 33.2 |

As shown in Table 6, the fiber properties indicate weaker tensile strength for treated fibers (4 wt % GC in 1$^{st}$ draw bath) compared to that of untreated fibers, but equal modulus. Surprisingly, the treated fiber exhibits greater tensile strength, albeit slightly weaker modulus, as compared to the untreated fiber when oxidized according to condition 7. Observation of the treated fibers using SEM-EDX imaging revealed no evidence of an oxidation gradient or skin-core pullout at the lower oxidation temperature (condition 7).

Example 4 (Inventive). Precursor Fiber Dipped in Guanidine Carbonate in 1st Draw Bath and in Coagulation SM PAN precursor fiber was prepared (1% comonomer). 2 wt % or 4 wt % GC was used in the 1st draw bath, and/or 2 wt % GC was used in the coagulation bath.

DSC was used to analyze the treated precursor fibers. The peak heat flows and corresponding temperatures are shown in Table 7.

TABLE 7

| Fiber | Heat flow (W/g) | Temperature (° C.) |
|---|---|---|
| Untreated | 10.19 | 275.03 |
| 2 wt % GC in 1st draw | 7.839 | 271.53 |
| 4 wt % GC in 1st draw | 6.262 | 270.99 |
| 4 wt % GC in 1st draw and 2 wt % GC in coag | 5.626 | 270.85 |
| 2 wt % GC in coag | 6.000 | 270.72 |

As shown in Table 7, each successive addition of guanidine carbonate and use in earlier stages promoted exotherm reduction. Surprisingly, the low GC concentration in coagulation alone can be more beneficial than a higher concentration of GC in the 1st draw bath alone with respect to exotherm reduction.

The precursor fibers were then subjected to two different oxidation treatments, conditions 6 and 8 shown in Table 3. For both sets of oxidation experiments, carbonization was run with 5% precarb stretch and 4% carbonization relax with a final carbonization temperature of 1,300° C. The resulting carbon fiber properties are summarized in Table 8.

TABLE 8

| Fiber | Ox condition | Tensile strength (ksi) | Tensile modulus (Msi) | Core ratio (%) |
|---|---|---|---|---|
| Untreated | 6 | 594 | 37.9 | 24.56 |
| 4 wt % GC in 1st draw | 6 | 570 | 35.8 | 32.52 |
| 4 wt % GC in 1st draw and 2 wt % GC in coag | 6 | 569 | 35.5 | 25.20 |
| Untreated | 8 | 497 | 35.2 | 30.87 |
| 4 wt % GC in 1st draw | 8 | 544 | 35.2 | 37.58 |
| 4 wt % GC in 1st draw and 2 wt % GC in coag | 8 | 554 | 37.2 | 35.31 |

As shown in Table 8, the treated samples performed with equivalent or better tensile properties when compared to the control (untreated) fiber in the case for the higher speed and higher temperatures (condition 8). This result shows that it is possible to achieve superior CF performance by combining early stage GC treatment with higher throughput.

What is claimed is:

1. A process for producing carbon fibers, the process comprising:

a) preparing a polymer solution comprising polyacrylonitrile (PAN) polymer b) spinning the polymer solution in step (a) by wet spinning or air-gap spinning to form carbon fiber precursor fibers, wherein spinning the polymer solution comprises filtering and extruding the polymer solution into a coagulation bath;

c) drawing the carbon fiber precursor fibers through one or more draw and wash baths, resulting in drawn carbon fiber precursor fibers that are substantially free of solvent; and d) oxidizing the drawn carbon fiber precursor fibers of step c) to form stabilized carbon fiber precursor fibers and then carbonizing the stabilized carbon fiber precursor fiber thereby producing carbon fibers;

wherein at least one salt of an organic cation containing a C═N imine group is added to the polymer solution in step a) and/or to the coagulation bath in step b);

wherein at step a) comprises polymerizing acrylonitrile with one or more co-monomer(s) in a medium in which the resulting PAN polymer is sparingly soluble or non-soluble to form a mixture, adding the salt of an organic cation containing a C═N imine group to the mixture, isolating the resulting polymer, and dissolving the resulting polymer in one or more solvents to form the polymer solution.

2. A process for producing carbon fibers, the process comprising:

a) preparing a polymer solution comprising polyacrylonitrile (PAN) polymer b) spinning the polymer solution in step (a) by wet spinning or air-gap spinning to form carbon fiber precursor fibers, wherein spinning the polymer solution comprises filtering and extruding the polymer solution into a coagulation bath;

c) drawing the carbon fiber precursor fibers through one or more draw and wash baths, resulting in drawn carbon fiber precursor fibers that are substantially free of solvent; and d) oxidizing the drawn carbon fiber precursor fibers of step c) to form stabilized carbon fiber precursor fibers and then carbonizing the stabilized carbon fiber precursor fiber thereby producing carbon fibers;

wherein at least one salt of an organic cation containing a C═N imine group is added to the polymer solution in step a) and/or to the coagulation bath in step b);

wherein preparing the polymer solution comprises polymerizing acrylonitrile with one or more co-monomer(s) in a medium in which the resulting PAN polymer is soluble to form a solution, and adding the salt of an organic cation containing a C═N imine group to the solution to form the polymer solution.

3. The process according to claim 1, wherein the salt of an organic cation containing a C═N imine group is added to the polymer solution in an amoung from 0.5 wt. % to 2 wt. %, relative to the weight of the polymer solution.

4. The process according to claim 1, wherein the one or more comonomer(s) is/are selected from the group consisting of methacrylic acid (MAA), acrylic acid (AA), itaconic acid (ITA), vinyl-based esters, and other vinyl derivatives; and mixtures thereof.

5. The process according to claim 2, wherein the one or more comonomer(s) is/are selected from the group consisting of itaconic acid, methacrylic acid, methyl acrylate, and mixtures thereof.

6. The process according to claim 2, wherein the salt of an organic cation containing a C═N imine group added to the mixture is in the form of an aqueous solution, the concentration of the salt in the aqueous solution being 2 wt % to 30 wt % relative to the weight of the aqueous solution.

7. The process according to claim 6, wherein the at least one salt of an organic cation containing a C═N imine group is added to the coagulation bath in step b).

8. The process according to claim 7, wherein the salt of an organic cation containing a C═N imine group is present in the coagulation bath in an amount of less than or equal to 15% by weight relative to the weight of the coagulation bath.

9. The process according to claim 7, wherein the carbon fiber precursor fibers formed are in the coagulation bath for less than or equal to 15 minutes.

10. The process according to claim 1, wherein the salt of an organic cation containing a C═N imine group is added in an amount effective for the organic cation containing a C═N imine group to be substantially uniformly distributed throughout the carbon fiber precursor fibers formed in step c).

11. The process according to claim 1, wherein the salt of an organic cation containing a C═N imine group is a salt of guanidinium ion, amidinium ion, or pyrimidinium ion.

12. The process according to claim 1, wherein the carbon fibers produced have a core ratio of from 10% to 50%.

13. The process according to claim 1, wherein the carbon fibers produced have a tensile strength of from 450 to 1000 ksi.

14. The process according to claim 1, wherein the carbon fibers produced have a tensile modulus of from 30 to 48 msi.

15. A process for producing carbon fibers, the process comprising: a) preparing a molten polymer comprising polyacrylonitrile (PAN) polymer and at least one salt of an organic cation containing a C═N imine group; b) spinning the molten polymer prepared in step (b) using a spinneret; thereby forming carbon fiber precursor fibers; c) drawing the carbon fiber precursor fibers through one or more draw and wash baths, resulting in drawn carbon fiber precursor fibers that are substantially free of solvent; and d) oxidizing the drawn carbon fiber precursor fibers of step (c) to form stabilized carbon fiber precursor fibers and then carbonizing the stabilized carbon fiber precursor fiber, thereby producing carbon fibers, wherein step (a) comprises polymerizing acrylonitrile with one or more co-monomer(s) in a medium in which the resulting PAN polymer is sparingly soluble or non-soluble to form a mixture, adding the at least one salt of an organic cation containing a C═N imine group to the mixture, isolating the resulting PAN polymer, and heating the PAN polymer until it is in a molten state.

16. The process according to claim 15, wherein the at least one salt of an organic cation containing a C═N imine group is present in step (a) in an amount effective for the organic cation containing a C═N imine group to be substantially uniformly distributed throughout the carbon fiber precursor fibers formed in step (c).

17. The process according to claim 15, wherein the salt of an organic cation containing a C═N imine group is a salt of guanidinium ion, amidinium ion, or pyrimidinium ion.

* * * * *